US006026658A

United States Patent [19]

Weller

[11] Patent Number: 6,026,658

[45] Date of Patent: Feb. 22, 2000

[54] CONVERTIBLE JEWELRY ARTICLE

[75] Inventor: Evelyn Weller, Exeter, R.I.

[73] Assignee: Oombi, Inc., Exeter, R.I.

[21] Appl. No.: 09/104,613

[22] Filed: Jun. 25, 1998

[51] Int. Cl.[7] ..... A44C 13/00

[52] U.S. Cl. ..... 63/1.11; 63/1.16; 63/13; 63/14.1; 63/20

[58] Field of Search ..... 63/1.11, 1.16, 63/1.17, 12, 13, 14.1, 14.2, 14.3, 14.4, 14.5, 14.6, 14.7, 20, 40

[56] References Cited

U.S. PATENT DOCUMENTS

| | | | |
|---|---|---|---|
| Re. 22,729 | 3/1946 | Hubbell | 63/14.1 |
| 3,122,007 | 2/1964 | Horland | 63/12 |
| 4,653,292 | 3/1987 | Maupin et al. | 63/12 |
| 4,899,556 | 2/1990 | Ford | 63/14.1 |
| 5,048,310 | 9/1991 | Riley | 63/13 |
| 5,048,311 | 9/1991 | Mastrobuono | 63/12 |
| 5,062,436 | 11/1991 | Emsellem . | |
| 5,365,955 | 11/1994 | Desgroux et al. . | |
| 5,438,850 | 8/1995 | Keating et al. | 63/12 X |
| 5,495,862 | 3/1996 | Dewing . | |
| 5,582,037 | 12/1996 | DiDomenico | 63/12 |
| 5,666,982 | 9/1997 | Pignon . | |

*Primary Examiner*—Terry Lee Melius
*Assistant Examiner*—Andrea Chop
*Attorney, Agent, or Firm*—Salter & Michaelson

[57] ABSTRACT

A convertible jewelry article including a mounting wand and clip assembly releasably secured to an ornamental jewelry button. The mounting clip is releasably snap received with the back side of the jewelry button. The convertible jewelry article further includes a variety of different mounting wand and clip assemblies as well as a variety of differently styled ornamental jewelry buttons. The combination of different mounting wand and clip assemblies and different ornamental jewelry buttons provides the user with a wide range of different jewelry options. The mounting wand cooperates with a selected ornamental button to be worn on the person as an article of jewelry in a variety of different ways.

1 Claim, 4 Drawing Sheets

CONVERTIBLE JEWELRY ARTICLE

BACKGROUND AND SUMMARY OF INVENTION

This invention relates generally to jewelry, and more particularly, to a combination mounting clip and ornamental button wherein the mounting clip is releasably attached to the backside of the button for effectively creating a variety of different jewelry pieces. The mounting clip is adapted to receive one of a number of different mounting wand accessories including earposts, earwires, necklace bails, barpins with necklace bails, double wand barpins, stick pins, shoe clips, and scarf clips. The buttons include a variety of different ornamental buttons which may be interchangeable with the desired mounting wand. The arrangement is such that the mounting clip and its wand are releasably attached to the backside of the button for creating the desired jewelry piece.

In the fashion and jewelry industry, it is desirable to provide a wide range of differently styled jewelry pieces. For the consumer, it can become very expensive and inconvenient to maintain a large collection of jewelry pieces. The instant invention is directed to convertible jewelry which includes a variety of different mounting clip and wand assemblies which are releasably attached to the backside of any one of a variety of selectively chosen ornamental jewelry buttons for creating a wide range of differently styled jewelry pieces. The plurality of differently styled buttons in combination with the variety of different mounting clip and wand assemblies provides the consumer with a large number of different styled jewelry pieces to choose from.

The instant invention is directed to a convertible jewelry article comprising a conventional button having an ornamental front side and a generally planar back side, the back side having a strap extending therefrom for releaseably receiving a mounting clip therein, it being understood that the strap is the conventional means that exists on the back of a button for permitting the button to be sewn on a garment. The mounting clip includes a leg portion and an arm portion which integrally extends from a first end of the leg portion. The arm portion is reversely bent back over the leg portion in spaced relation thereto, the arm portion being normally biased to a spaced position away from the leg portion, and being movable from the normal position to a depressed position. The arm portion includes a locking tab extending upwardly from an intermediate portion thereof, and the leg portion includes oppositely disposed outwardly extending shoulders at a second end thereof, opposite the first end. The mounting clip is snap-received into the strap on the back side of the button wherein the shoulders engage with one edge of the strap, and the locking tab engages with an opposing edge of the strap to releaseably lock the clip and button in assembled relation. The jewelry article further includes a variety of different mounting wand accessories secured to the clip for attaching the button and clip assembly to a wearer of the jewelry article.

Accordingly, among the several objects of the instant invention are: the provision of a convertible jewelry article which includes a variety of different mounting wand and clip assemblies; the provision of a convertible jewelry article which includes a variety of different ornamental buttons; the provision of a convertible jewelry article wherein the selected mounting wand assembly is releasably secured to the back side of the selected ornamental jewelry button; the provision of a convertible jewelry article wherein the mounting wand assemblies and the jewelry buttons are interchangeable to provide a large number of different jewelry options; the provision of a convertible jewelry article which is neat and attractive in appearance; the provision of convertible jewelry article which is simple and easy to use; and the provision of convertible jewelry article which is cost efficient and easy to manufacture.

Other objects, features, and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
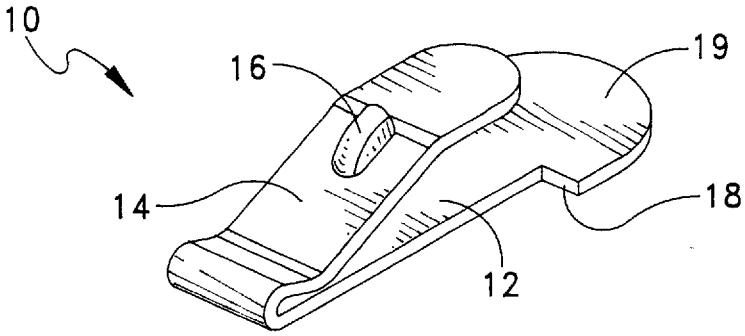
FIG. 1 is a perspective view of the clip that forms a part of the instant invention.

Referring now to the drawings, and more particularly to FIG. 1, the mounting clip of the instant invention is shown and generally indicated at 10. As will hereinafter be more fully described, the instant invention provides for a combination mounting clip and jewelry button assembly, wherein the mounting clip is releasably received in a looped strap conventionally located on the backside of the button. The convertible jewelry article includes a variety of different mounting wand accessories, each of which is secured to a different clip so that any selected wand and clip assembly may be releaseably attached to any selected ornamental button to provide a plurality of different jewelry options.

Figure 2:
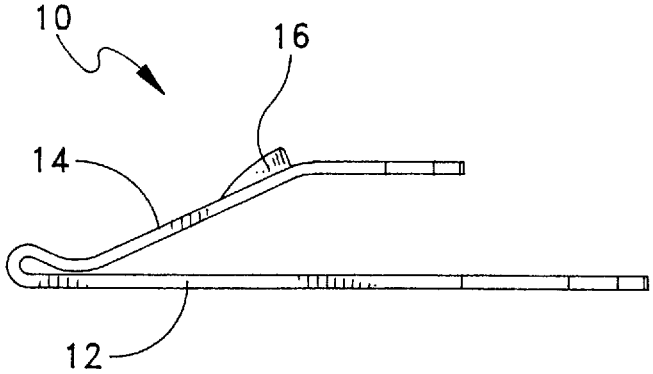
FIG. 2 is a side view thereof.
Figure 3:
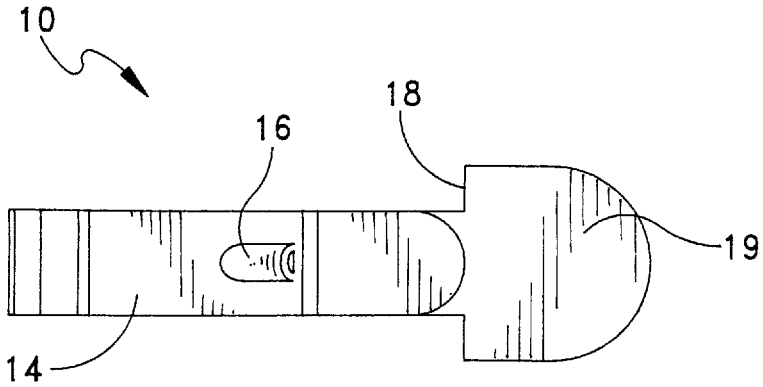
FIG. 3 is a top view thereof.

Referring now to FIGS. 1–3, the mounting clip of the instant invention is shown and generally indicated at 10. The mounting clip includes a leg or base portion 12, and an arm portion 14 which integrally extends from a first end of the leg portion 12 and is reversely bent back thereover in spaced relation thereto. The arm portion 14 is normally biased to a spaced position away from the leg portion 12, but is movable from the normal position to a depressed position when the mounting clip is press fitted into a loop located on the backside of the jewelry button. The arm portion 14 includes an integrally struck locking tab 16 which extends upwardly from an intermediate portion thereof, and the leg portion 12 includes oppositely disposed outwardly extending shoulders 18 at a second end thereof, opposite the first end for releasable attachment of the clip 10 to a button, as is hereinafter more fully described. A selected mounting wand accessory is secured to the arcuate end portion 19 of the mounting clip 10 by any suitable means, such as soldering or the like. Specifically, the mounting wand accessory is fixedly secured to the portion 19 and extends outwardly therefrom for appropriate attachment to the body or garment of the person wearing the jewelry article. The locking tab 16, which extends upwardly from the spring biased arm 14 of the mounting clip 10, cooperates with shoulders 18 to snap-lock the clip 10 to the button as is more fully hereinafter described.

Figure 4:
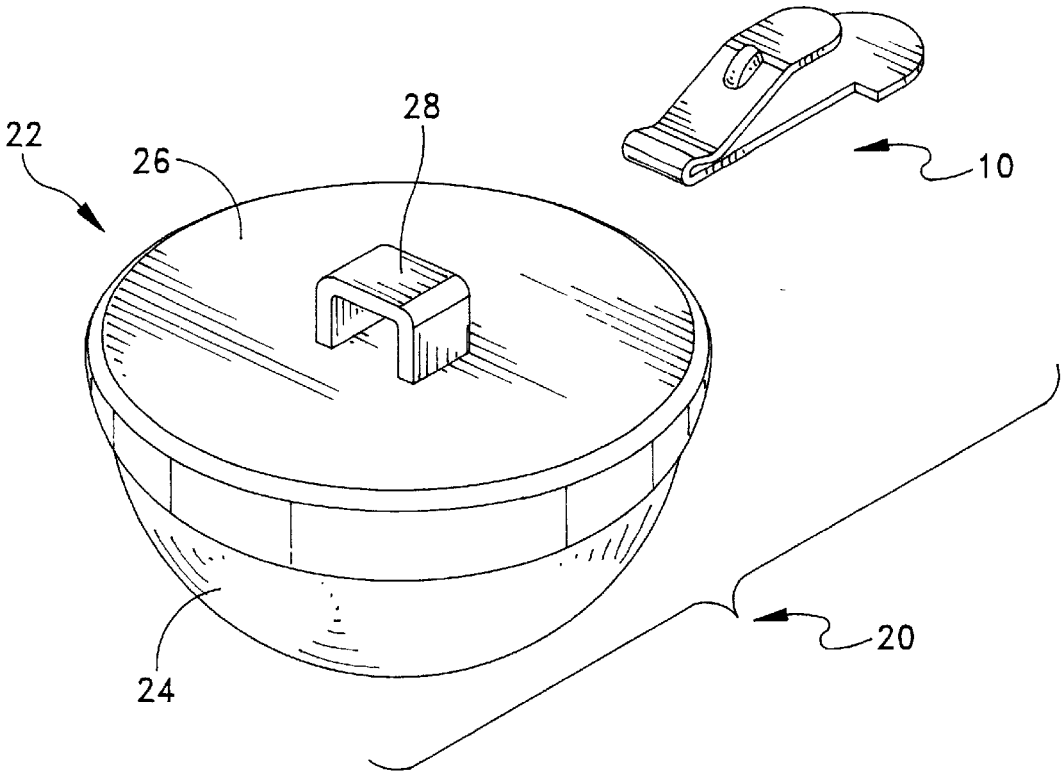
FIG. 4 is an exploded perspective view of the ornamental button and the clip of the instant invention.
Figure 5:
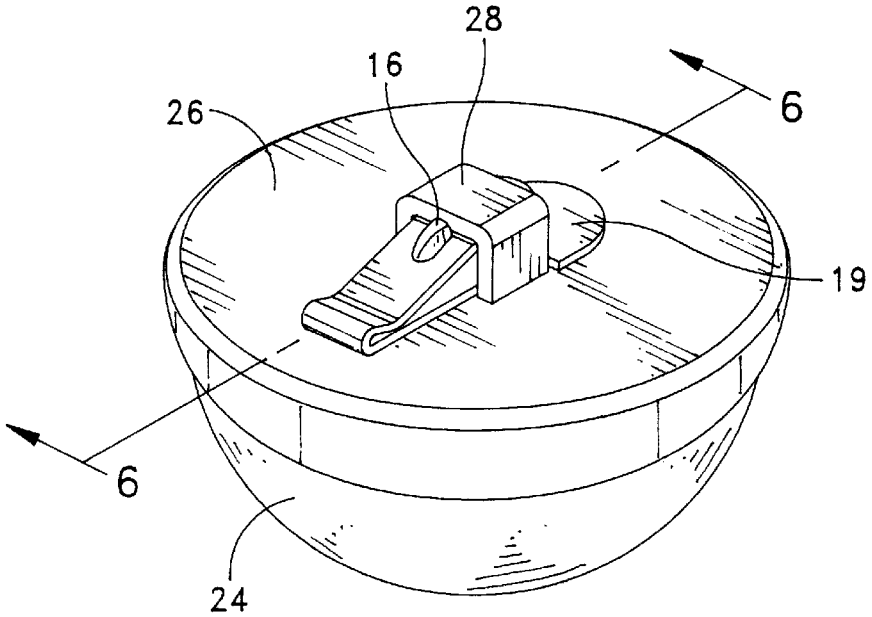
FIG. 5 is a perspective view showing the clip received within the attaching loop of the button.
Figure 6:
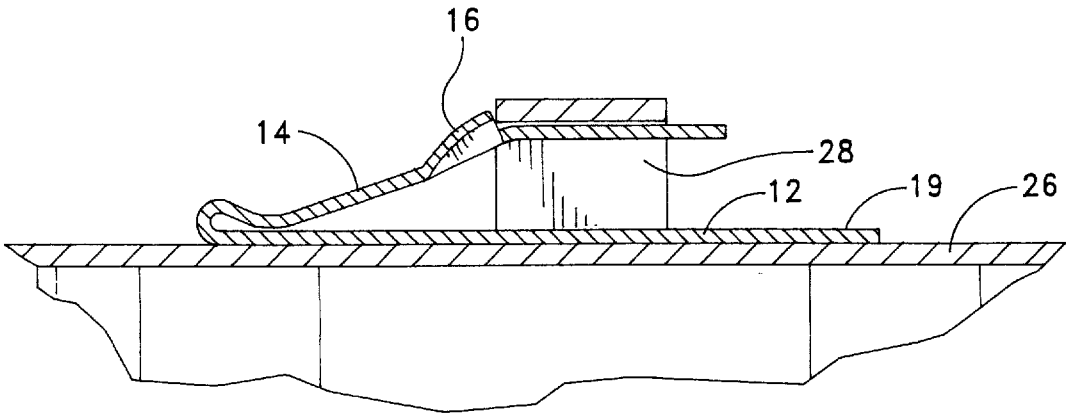
FIG. 6 is an enlarged fragmentary cross-section taken along line 6—6 of FIG. 5.
Figure 7:
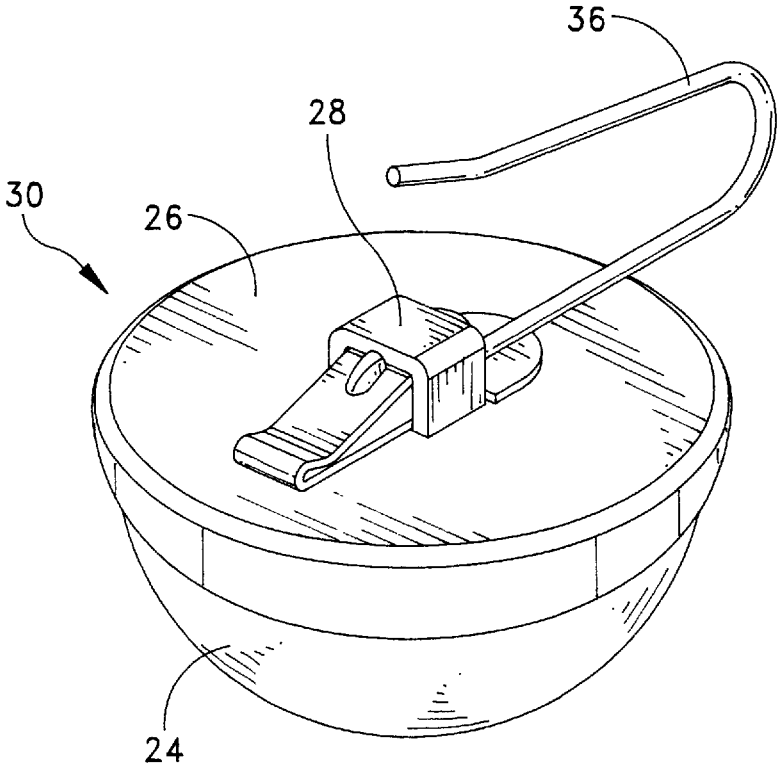
FIG. 7 is a perspective view of the ornamental button and clip assembly of the instant invention in combination with a first jewelry wand accessory, namely an ear wire.
Figure 8:
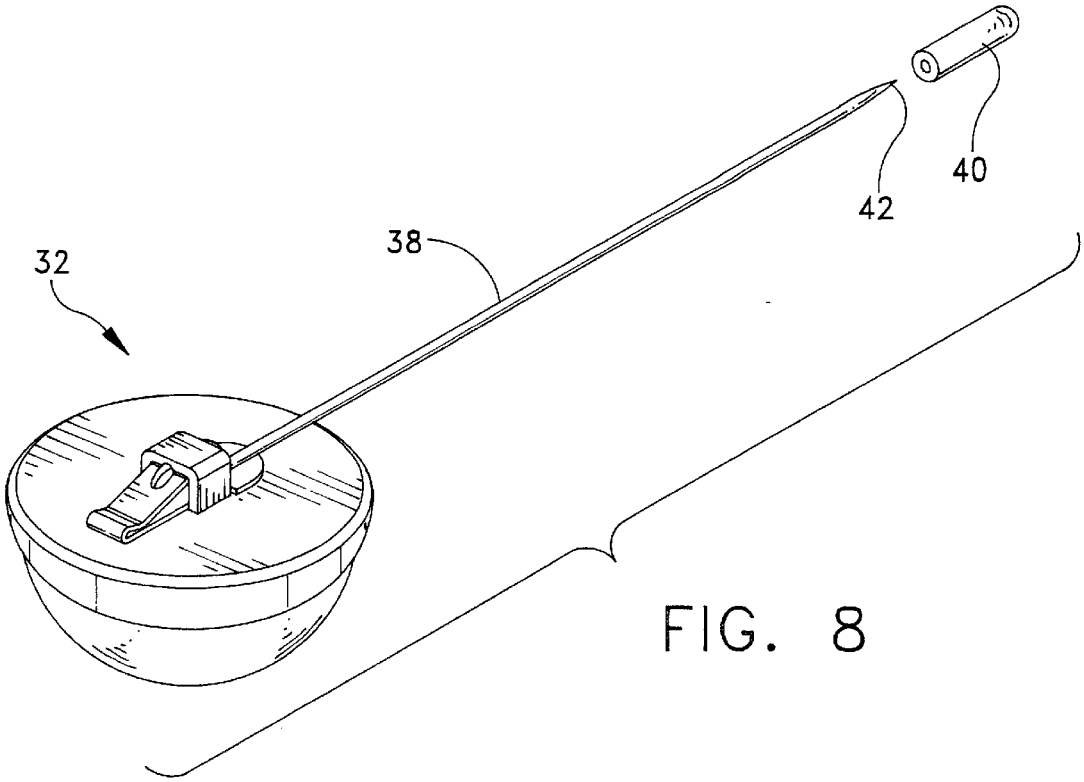
FIG. 8 is a perspective view of the ornamental button and clip assembly of the instant invention in combination with a second jewelry wand accessory, namely a stick pin.
Figure 9:
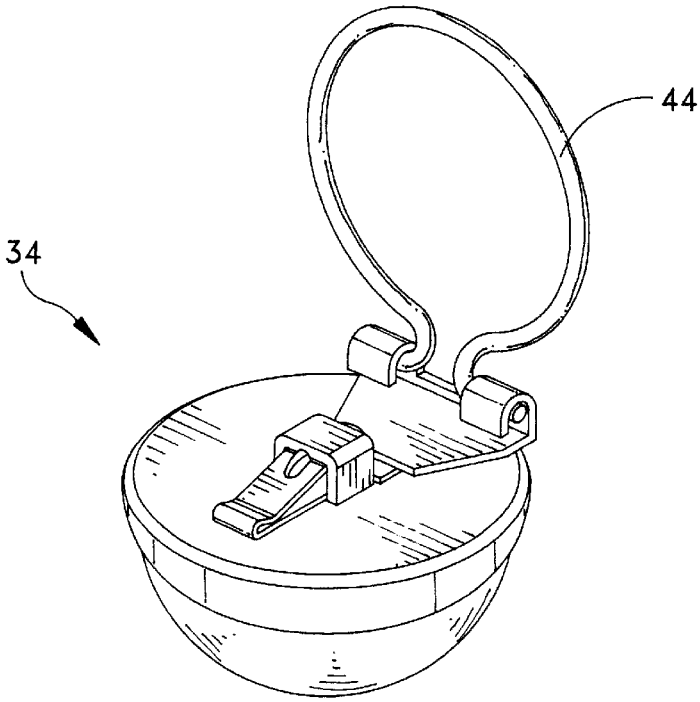
FIG. 9 is a perspective view of the ornamental button and clip assembly of the instant invention in combination with a third jewelry wand accessory, namely a scarf clip.

Referring now to FIGS. 4–6, the convertible jewelry article of the instant invention is shown and generally indicated at 20. A conventional ornamental button is shown and generally indicated at 22. The button 22 has an ornamental front side 24 and a planar backside 26 which is hidden from view when the button is worn as an article of jewelry. The back side 26 has a conventional looped strap 28 extending outwardly therefrom for releaseably receiving the selected mounting clip and wand assembly. Specifically, the selected mounting clip is slidably inserted into the strap 28 so that it is secured to the back side 26 of the jewelry button 22, as shown in FIG. 5. As will be noted, the spring biased arm 14 of the mounting clip 10 is forced downwardly to a depressed position so that it may be slidably inserted under the strap 28 until the locking tab 16 passes through the strap, at which point the arm 14 moves back up to its normal position and locks the mounting clip 10 to the back side 26 of the jewelry button 22. More specifically, when the mounting clip 10 is received within the strap 28, the shoulders 18 of the clip engage one edge of strap 28 and the locking tab 16 engages the opposite edge thereof to capture the strap therebetween. Referring now to FIGS. 7–9, three different embodiments of the convertible jewelry article 20 of the instant invention are shown and generally indicated at 30, 32, and 34. Referring first to FIG. 7, the convertible jewelry article 30 is shown with an ear wire 36 fixedly secured to the portion 19 of the mounting clip 10. This convertible jewelry article 30 shows an earring which would be worn by a person having pierced ears. It should be noted that the earwire mounting wand accessory 36 and its associated clip 10 may be easily removed from the strap 28 of the jewelry button 22 and combined with any number of other desirable ornamental jewelry buttons 22 to accommodate the user's preference.

Referring now to FIG. 8, a second embodiment of the convertible jewelry article is shown and generally indicated at 32. The convertible jewelry article 32 is shown with a stick pin 38 fixedly secured to the portion 19 of the mounting clip 10. As previously described, the stick pin 38, as well as earwire 36, are secured to the mounting clip 10 by any suitable means, such as soldering, and extend outwardly therefrom for attachment to the body or garment of the wearer. A friction clutch 40 is provided so that the sharp end 42 of the pin 38 may be inserted therein after the stick pin has been mounted or when it is not in use. Once again, it should be noted that any number of desirable jewelry buttons 22 may be interchangeable with the stick pin mounting wand accessory.

Referring now to FIG. 9, a third embodiment of the convertible jewelry article is shown and generally indicated at 34. This embodiment shows a scarf clip 44 fixedly secured to the portion 19 of the mounting clip 10. It will be understood that the wand accessories of FIGS. 7, 8, and 9 are merely illustrative of the many accessories that may be utilized with the instant invention. Other possible accessories are ear posts, clip-on earrings, barpins, shoe clips, cuff links, ring bases, bracelets, tie tacks, button covers, collar points, lapel pins, pearl enhancers, bead shorteners, bolo slides, chain and necklace slides, eyeglass enhancers and holder tips, jump rings, spring rings, split rings, lobster claw clasps, and hair accessories.

It can therefore be seen that the instant invention provides a convertible jewelry article which is effective for creating a wide variety of different jewelry button accessories. The convertible jewelry button assembly includes a mounting clip and wand system wherein there are numerous different mounting wand accessories that may be utilized. The arrangement is such that the desired mounting wand accessory with its respective clip is releasably secured to the back side of a selected ornamental button for creating a desired jewelry assembly. The mounting wand system of the convertible jewelry button of the instant invention effectively provides the user with a wide variety of different jewelry buttons to choose from, and a wide variety of different wand assemblies that may be used with whichever button is chosen. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept, and that the same is not limited to the particular forms herein shown and described except insofar as indicated by the scope of the appended claims.

What is claimed is:

1. A convertible jewelry article comprising:

a button having an ornamental front side and a generally planar back side, and further having a looped strap extending from said back side;

a mounting clip having a leg portion having a longitudinal axis and an arm portion integrally extending from a first end of said leg portion, said arm portion reversely bending back over the leg portion in spaced relation, said arm portion being normally biased to a spaced position away from the leg portion, and being movable from said normally biased position to a depressed position, said arm portion including a locking tab extending upwardly therefrom, said leg portion terminating in a mounting portion at a second end thereof opposite said first end, said mounting portion being coplanar with said leg portion and including outwardly extending shoulders which extend transversely to said longitudinal axis of said leg portion, said mounting clip being slidably inserted into the strap on said button back side with said leg portion lying flat against said back side, said shoulders engaging one edge of the strap, said locking tab engaging the opposite edge of the strap to securely lock said clip to said strap when said arm portion is in its normally biased position; and means fixedly attached to said mounting portion for enabling said button to be worn on a person as an article of jewelry.

* * * * *